United States Patent [19]

Maillefer et al.

[11] 3,969,880

[45] July 20, 1976

[54] MACHINE FOR MANUFACTURING CABLES BY STRANDING INDIVIDUAL WIRES

[75] Inventors: Charles Maillefer, Renens; René Schlaeppi, Prilly, both of Switzerland

[73] Assignee: Maillefer S.A., Switzerland

[22] Filed: Feb. 18, 1975

[21] Appl. No.: 550,739

[30] Foreign Application Priority Data

Mar. 1, 1974 Switzerland ..... 2961/74
Nov. 18, 1974 Switzerland ..... 15327/74

[52] U.S. Cl. ..... 57/6; 57/58.52; 57/106; 57/59; 57/58.86

[51] Int. Cl.[2] ..... D01H 7/02

[58] Field of Search ..... 57/3, 6, 13, 14, 15–19, 57/34 R, 58.49, 58.54, 58.7, 58.83, 58.86, 59–65, 106, 108, 113, 127.5, 156, 160, 161, 166

[56] References Cited

UNITED STATES PATENTS

| | | | |
|---|---|---|---|
| 1,956,730 | 5/1934 | Reichelt | 57/160 |
| 2,927,416 | 3/1960 | Haugwitz | 57/106 X |
| 3,360,919 | 1/1968 | Burr | 57/59 |
| 3,493,017 | 2/1970 | Govaert | 57/18 X |
| 3,745,764 | 7/1973 | Petrov | 57/59 |

*Primary Examiner*—Donald E. Watkins
*Attorney, Agent, or Firm*—Stevens, Davis, Miller & Mosher

[57] ABSTRACT

A machine for manufacturing cables by stranding individual wires, comprising: a pay-out apparatus having four pay-out reels and fixed supports therefor; a stranding apparatus situated after the pay-out apparatus and comprising a forming die receiving the individual wires; a take-up apparatus having a take-up reel, a support for the take-up reel, and a cable-puller for pulling the cable through the die at a predetermined speed; and further comprising wire-tensioning devices disposed between each of the pay-out reel supports and the die, each of the wire-tensioning devices comprising a guide member for one of the wires, disposed at a fixed location and coaxial with a respective one of the reels, a zone situated before the guide member for non-guided passage of a portion of the wire from the reel to the guide member, a motor for driving each of the pay-out reels at a variable speed of rotation, the speed being sufficient to cause the portion of wire to assume the form of a loop under the effect of centrifugal force, thus tensioning the wire through the centrifugal force, and apparatus independent of the cable-puller for controlling the variable speed of rotation, the speed of rotation being constantly the same for all the pay-out reels.

14 Claims, 7 Drawing Figures

Figure 1:
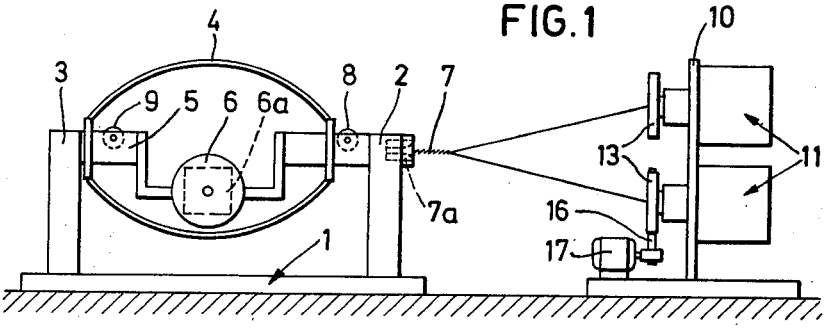

FIG. 4
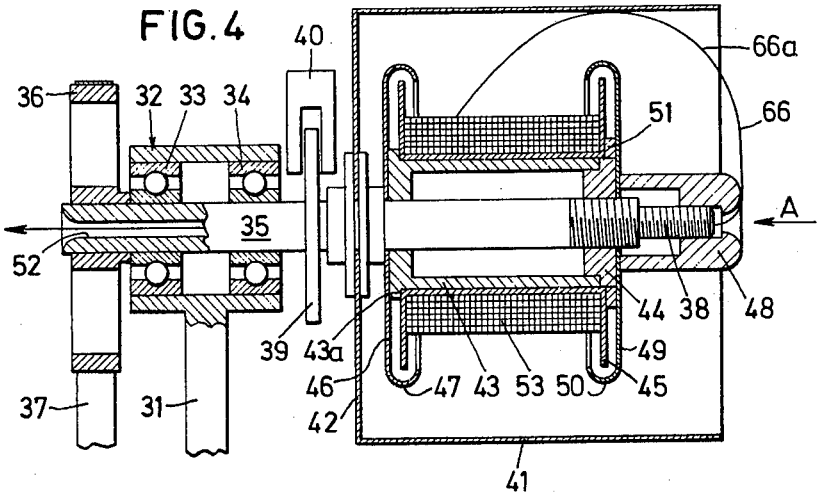
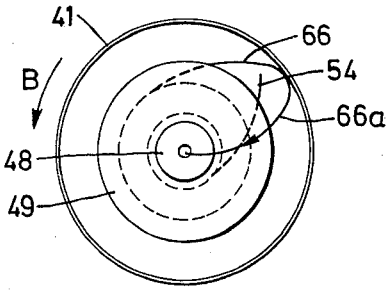
FIG. 5
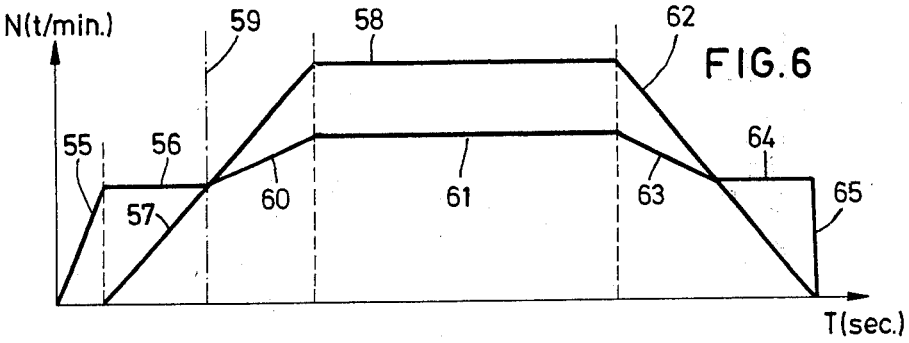
FIG. 6

MACHINE FOR MANUFACTURING CABLES BY STRANDING INDIVIDUAL WIRES

This invention relates to a machine for manufacturing cables by stranding individual wires, comprising a pay-out apparatus having pay-out reels and supports therefor, a stranding apparatus having a die, and a take-up apparatus having a take-up reel, a support therefor, and cable-pulling means.

The manufacture of cables formed of metal wires, especially of electrical conductors, is constantly being improved in order to achieve increasingly higher rates of production.

At the same time, however, the quality specifications for such cables are likewise being raised.

This applies particularly to telephone cables consisting of quads, i.e., those in which the conductors are twisted four by four. In order to achieve good efficiency in the transmission of messages and to avoid crosstalk, these quads must exhibit well-defined electrical characteristics. In practice, the quality is determined by measuring the resistances, inductances, and capacitances on the finished cables. The values used are, among others, $K_1$, $K_2$, $K_3$, $K_{11}$, $K_{22}$, etc.

One requirement which is difficult to satisfy is to obtain rather small capacitance unbalances. The value $K_1$ (called the pair-to-pair capacitance unbalance, takes into account the capacitances of the ground wires, $C_1$ to $C_4$; it cannot be measured on the production reel. In practice, the value measured on the reel, $K_1' = C_{13} + C_{24} - C_{14} - C_{23}$, is used instead. In any event, $K_1$ and $K_1'$ are very close in the cable.

The capacitance unbalances between each pair and the phantom circuit are expressed by the following equations, leaving the ground capacitance out of consideration:

$$K_2 = C_{23} + C_{24} - C_{13} - C_{14} + \left(\frac{C_1 - C_2}{2}\right)$$

$$K_3 = C_{24} + C_{24} - C_{13} - C_{23} + \left(\frac{C_3 - C_4}{2}\right)$$

The lower the values $K_1'$, $K_2$, and $K_3$, the better the quads and the weaker the crosstalk.

It is the value $K_1'$ which must be watched above all, for the norms for that quantity are strict.

To obtain good cables, i.e., ones with a low $K_1'$ value, an effort is made to use four insulated conductors which are as similar as possible. However, it is found that this condition is not sufficient and that the quadding operation, i.e., the assembling of the four conductors, plays an important part. Even with perfect conductors, it is quite possible for the capacitance unbalances to exceed the permissible tolerances.

The capacitances between conductors assuming that they touch each other, and hence the capacitance unbalances, can be calculated theoretically. The values obtained by the calculation are generally very small, i.e., within the tolerances. No clear doctrine has ever been formulated concerning the origin of the often high unbalances obtained in practice. Nevertheless, by manipulating quads, it will be found that if two adjacent conductors are separated for a certain distance, the unbalances are greatly increased. It may therefore be assumed that the capacitance unbalances derive from a geometric fault in the position of the conductors, even if it is not possible to determine the relative displacement of the conductors and their separation by having seen it.

For a long time, the problem of assembling the four conductors was likened to that of steel wires, where it is usual to subject them to untwisting. Since a steel wire is very rigid, it does not take well to the twisting it undergoes during its assembly with other wires, and this keeps it from lying tangent to the adjacent wires. For many years, untwisting was applied in the manufacture of quads, but it is realized nowadays that this step does not suffice at high speeds and having regard to the increasingly strict specifications.

It has also been attempted to improve the quality of the quads by forcing the four conductors to advance towards the point of assembly at equal speeds through the use of capstans. The results have not come up to expectations.

Other designers have sought to impart constant and equal mechanical tensions to all four conductors, for it is obvious that if one conductor is relaxed, it will move away from the center of the quad, thus possibly creating a gap between it and the adjacent conductors. Here, too, the equalizing of the tensions has not provided the solution sought, particularly not at high speeds.

In general, stranding machines are equipped with pay-out drums or bins or with unwinding devices on which pay-out reels are mounted; and it is known that when the wires are pulled from the pay-out apparatus at high speed, they are subjected to jerks which may prove prejudicial. In the known stranding machines, it has already been sought to reduce such jerking by a well-planned design of the pay-out apparatus.

One known type of supply source is the unwinding type, where the axis of the pay-out reel is at right angles to the direction of travel of the wire. In the simplest design, it is the traction of the wire which causes the reel to rotate about its axis. It is suitable for use only in cases where the wire is resistant enough to overcome the friction and the unbalance of the reel. To remedy this drawback, the pay-out reel may be driven by a motor. This motor may provide a torque as a function of the speed of the reel simply to assist its unwinding and to reduce the tension on the wire. It may also be a variable-speed motor controlled by an accumulation of wire. When there is little accumulation, the motor receives the order to speed up, and in the opposite case, to slow down. Care must be taken that this closed control circuit is stable. Moreover, although this process results in a constant, medium tension, the irregularities of the turns of wire on the reel impart jolts to the accumulation device, among other things to its feeling head, the inertia of which prevents the short-term variations in the tension of the wire from being damped. At very high speeds, this phenomenon may be prejudicial, for it imparts a vibration to the wire being unwound. Another drawback of the system lies in the cost of the variable-speed motor and of the automatic control circuit.

The stationary type of supply source, where the axis of the stored coil of wire coincides with the direction of travel of the wire, and where, when a drum is used, the wire forms a loop rotating about one of the cheeks of the drum, is better suited to high speeds. A loop-guard is provided in the form of a cylinder or cone coaxial with the drum to keep the loop within a limited space. The wire, flung out by the centrifugal force resulting from the rotation of the loop, comes in contact with the loop-guard and is thus braked to a certain extent by friction. This braking differs according to whether the turn contacts the top or the bottom of the loop-guard, for its weight is subtracted from or added to the centrifugal force. Thus there are pulsations in the tension of the wire. A more serious defect appears at low speeds and upon starting up, when the loop of wire rotates too slowly for centrifugal force to move it away from the cheek of the drum. This drawback is eliminated by equipping the cheek of the drum with a stripping disc rotating at a speed which is equal to or greater than that of the loop of wire. This stripping disc is preferably set in rotation by an independent motor.

The drawback of paying out the wire in the direction of the axis of the stored supply, as just described, lies in the difficulty of imparting a predetermined tension to the wire. The tension is close to zero at low speeds, which necessitates a wire-brake in most cases. At high speed, the friction of the loop against the loop-guard increases the tension of the wire.

It has been noticed that low-amplitude irregularities in tension, or in other words small, brief jerks, can be the cause of capacitance unbalances in the quads. Such jerks cannot be detected by the usual measuring apparatus which have a not inconsiderable inertia due to the presence of the moving parts. It has been assumed that the origin of these irregularities in tension is to be found in the irregularities of the turns on the drums, in the vibrations of the wires passing over pulleys, and, generally speaking, in the material contacts between the wire, travelling at high speed, and any fixed or movable mechanical part such as guide members, etc.

These non-detected jerks, however, affect the positions assumed by the wires at the moment of their assembly, thus creating gaps, imperceptible to the naked eye, between the various insulated conductors of the quad. Spaces of only a few tenths of a millimeter for distances on the order of a meter suffice, it they are repetitive, to put the quad beyond the tolerances.

In certain processes for the manufacture or treatment of articles comprising very delicate wire or metal strips, devices are used which enable these wires or strips to be kept at a constant tension without their being subjected to the action of solid parts which are liable to damage them or to disturb the treatment they are undergoing. In some of these devices, for example, means exerting electromagnetic forces on the wire are used to keep it under tension.

It is the object of this invention to provide a machine for the manufacture of cables by stranding that will produce cables of better quality than heretofore at the highest speeds currently demanded. For that purpose, going on the aforementioned assumption that the origin of the noted shortcomings is in the irregularities of tension, undetectable by the known measuring apparatus and occurring despite the precautions already taken to avoid any jerks in the paying-out of the wires, it has been found possible to add to conventional stranding machines for cables, without any great complications, tensioning devices which likewise act without material contact between solid parts and the wires and to provide control means for regulating those devices. Experience has shown that an unexpected and unforeseeable improvement in the quality of the cables is obtained in this manner, especially when the machine is operating at very high speed.

To this end, the machine according to the present invention further comprises wire-tensioning means disposed between each of the pay-out reel supports and the die, and each wire-tensioning means in turn comprises at least one guide member for supporting a respective wire at a fixed location, a zone situated before that guide member for non-guided passage of a portion of the wire, means for subjecting the portion of wire within that zone to a force distributed throughout the length of the portion of wire, and control means independent of the cable-pulling means for regulating the aforementioned force.

In a preferred embodiment of the invention, the force distributed along the length of the wire is very simply obtained by having an independent motor rotate the pay-out reel about its axis. The wire being paid out forms a loop which is subjected to centrifugal force owing to the rotation of the reel. A loop-guard, either fixed or integral with the reel, may be provided about the zone through which the wire passes freely before arriving at the guide member. The tension is regulated by controlling the speed of rotation of the reel, which is independent of that of the cable-pulling means.

The advantage of the apparatus thus defined is that as soon as the reel is urged to rotate, there is nothing to prevent the wire from starting to move off rapidly, for centrifugal force lifts it off the reel. What is more, the resistance of the air or the friction exerted upon the wire by the loop-guard depends upon the speed of rotation of the reel. Thus the tension of the wire is regulated by choosing an appropriate speed of rotation for the reel or an appropriate diameter for the loop-guard. Once the reel has started to rotate, this tension of the wire is obtained without setting any moving parts in motion other than the wire itself. Thus there is low inertia, and this absorbs the jerks due to the irregularity of the turns on the reel.

Figure 2:
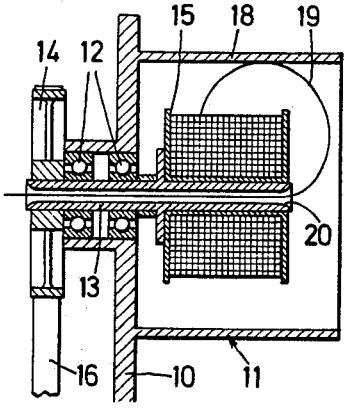
Figure 3:
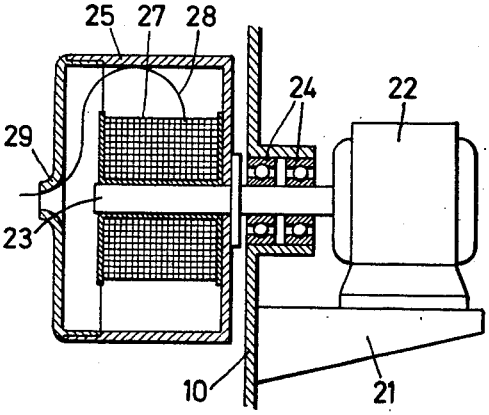
Figure 7:
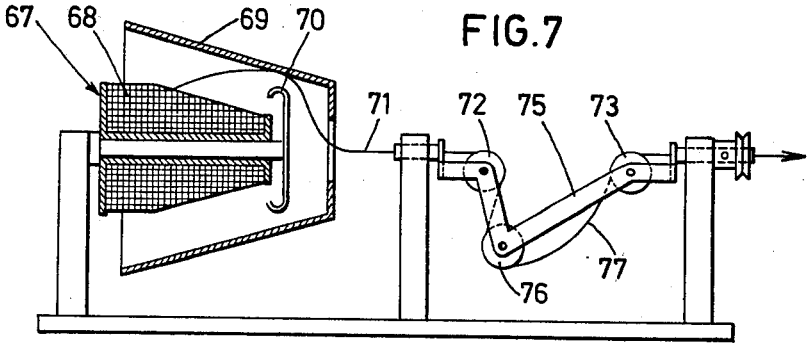

Several possible embodiments of a quadding machine according to the invention will now be described in detail with reference to the accompanying drawings, in which:

FIG. 1 is a diagrammatic elevation of the quadding machine showing two pay-out apparatus for the wires, FIG. 2 is a diagrammatic section of one of the pay-out apparatus on a somewhat larger scale, FIG. 3 is a section analogous to FIG. 2, showing a second embodiment with another form of pay-out apparatus, FIG. 4 is a partial section of still another form of pay-out apparatus, FIG. 5 is an elevation in the direction of the arrow A in FIG. 4, FIG. 6 is a graph illustrating the course of operations when the machine is started up, and FIG. 7 is a schematic of a further embodiment.

The quadding machine shown in the drawing is a double-twist machine. A base plate 1 equipped with two fixed uprights 2 and 3 carries a flyer 4 within which a cradle 5 bearing a take-up reel 6 is suspended. A quad 7 passes through a die 7*a*, integral with the upright 2, then over a guide-pulley 8 which directs it over one of the arms of the flyer 4, whence it is directed towards a pulley 9 in the axis of the quadding machine and finally arrives at the reel 6, which is driven rotatingly and pulls the quad and the wires from pay-out reels.

The flyer 4 and the die 7*a* constitute a stranding apparatus, while the cradle 5 and the support of the reel 6 constitute the take-up apparatus. The reel 6 is driven by a motor 6*a*, the stator of which is mounted on the cradle 5. The motor 6*a* constitutes a pulling means for the quad 7.

Situated before the assembly described above is a pay-out apparatus comprising a rigid frame 10 on which four pay-out units are mounted, each designated as a whole by the reference numeral 11, and two of which are shown in FIG. 1. A pay-out device 11 is illustrated in greater detail in FIG. 2. Shown there is part of the frame 10, comprising a bearing 12 in which there is mounted a reel support consisting of a tubular shaft 13 having a pulley 14 secured to one end of it. At the other end of the tubular shaft 13 is a rounded opening 20 which constitutes a guide member for a wire 19. The shaft 13 also carries a reel 15 which is driven rotatingly by the pulley 14 and by a belt 16 passing over a pulley of a motor 17 (FIG. 1).

A cylindrical loop-guard 18 is secured to the frame 10. It is coaxial with the reel 15 and extends out from the frame 10 slightly farther than the reel 15. The free end of the tubular shaft 13 is approximately level with the right-hand cheek of the reel 15, so that the wire 19 coming from the reel 15 passes freely from that reel to the guide member 20 and is then pulled inside the shaft 13 towards the point where the wires converge to form the quad 7.

It will be understood that if the reel 15 is rotated in a direction such that the turns on that reel have a tendency to hug closely to one another, and if the reel 6 which pulls the wires 19 towards the die 7*a* operates so as to pull those wires at a constant speed, the tension of the wires will be determined by the size of the loop formed by each wire between the reel 15 and the guide member 20 and by the speed of rotation of the reels, for these parameters determine the magnitude of the centrifugal force exerted on the loop. When a loop-guard 18 is provided, it serves to limit the radius of the loop and, consequently, to stabilize the operation of the apparatus. It may also serve to regulate the tension of the wire.

In order to reduce the friction between the loop and the loop-guard, if need be, the latter may be designed to rotate with the pay-out reel. This is the arrangement shown in FIG. 3, where the frame 10 may be seen together with, on a bracket 21, a motor 22, a shaft 23 of which being borne by a bearing 24. To the left of the bearing 24, the shaft 23 carries a loop-guard 25. The end portion of the shaft 23 forms a reel support on which a reel 27 is engaged. A wire 28 is paid out from the reel 27. It forms a loop within the loop-guard 25, and this loop runs through the annular free space surrounding the reel 27 and in front of the latter to a guide member 29, which is an opening in the center of the front face of the loop-guard 25.

The pay-out apparatus illustrated in FIGS. 4 and 5 is provided with various improvements which especially facilitate the insertion of the reels.

A frame 31 shown in FIG. 4 carries four pay-out units, each comprising a pivot device 32 composed of two ball-bearings 33 and 34 secured in a cylindrical housing crossing the frame 31. The four pivot devices 32 are distributed on the frame 31, preferably at the four corners of a square, and their axes are to be strictly parallel. Each of them bears a tubular shaft 35, one end of which is provided with a pulley 36 over which a belt 37 passes, and the other end of which has a thread 38, is free, and extends towards the front end of the machine in such a way as to be accessible. All the pulleys 36 are driven by a common motor (not shown) which will preferably be a variable-speed motor equipped with a control device so that the speed of the shafts 35 can be continuously varied from a full stop up to a predetermined maximum speed. The pulleys 36 and the belts 37 are so arranged that the four shafts 35 constantly rotate at the same speed, and preferably in the same direction, viz., counterclockwise as viewed in FIG. 5.

On the opposite side of the pivot device 32 from the pulley 36, the shaft 35 bears a brake-disc 39 embraced by a brake-shoe 40 of a type known per se. The brake may be controlled hydraulically or pneumatically.

The free portion of the shaft 35, which projects as an overhang beyond the disc 39, is intended to carry a reel 45 on which one of the wires 66 forming the quad is wound. In the present example, the wire 66 is wound clockwise as viewed in FIG. 5. The shaft 35 is further equipped with a cylindrical loop-guard 41 which may consist of a piece of sheet-metal connected to the shaft 35 at the end facing the bearings 33 and 34 by rigid, radially disposed connection means, which may be a circular, flat face-plate 42, rigidly secured to the shaft 35. The loop-guard 41 is coaxial with the shaft 35 and is open at the right-hand end, as viewed in FIG. 4, i.e., on the same side as the free end of the shaft 35. If need be, the inner surface of the loop-guard 41 may be coated with a finish intended to avoid any risk of damaging the wire 66, which is in permanent contact with that inner surface, as will be seen further on.

The portion of the shaft 35 which passes through the loop-guard 41 carries a reel support 43, in the form of a cylindrical sleeve, for example, which may be driven onto the shaft 35 and supported at the front end of the shaft by a ring 44 screwed onto the shaft. The outside diameter of the reel support 43 will be fitted to the inside diameter of the barrels of the reels 45 intended to be mounted on the pay-out apparatus being described. The reels 45 may thus be engaged on the support 43 axially so as to come up against a shoulder 43*a* at the left-hand end of that support, as viewed in FIG. 4.

The reel support 43 is secured to the shaft 35 in such a way as to hold in place a first protective channel 46 consisting of a metal disc, made of sheet-metal, for example, provided with a central opening which engages on the shaft 35 and having its peripheral edge bent back in a U-shape to form a circular groove 47. The entry diameter of the groove 47 is slightly larger than that of the cheeks of the reel 45. Thus the protective channel 46 is rigidly secured to the shaft 35 by the support 43, and when the reel 45 is set in place, the cheek of it facing the bearings 33 and 34 engages in the groove 47. The reel is secured by means of a bolt 48, the outer surface of which is cylindrical and the front end of which has a rounded profile, this bolt being screwed onto the thread 38 of the shaft 35. The bolt 48 holds a second protective channel 49, likewise in the form of a sheet-metal disc with its edge bent back to form a groove 50. The channel 49 may be integral with the bolt 48 or constitute a separate part. Preferably, it will be provided with a center ring 51 fixed to its inner surface and so dimensioned as to fit on the cylindrical bearing surface of the ring 44 and to press against the front cheek of the reel 45 when the bolt 48 is screwed onto the thread 38. Thus the reel 45 is rigidly secured to the shaft 35, and its two cheeks are covered by the protective channels 46 and 49.

The bolt 48 may also be equipped with a quick-closing device using a bayonet system, for example.

A central cylindrical channel 52 having both ends rounded runs all the way through the shaft 35; and as may be seen in FIG. 4, the wire 66 wound on the barrel of the reel 45 is led from the reel through the channel 52 from right to left, as viewed in FIG. 4. From the left-hand end of the shaft 35, the wire is directed to a quadding die in which it is assembled with identical wires coming from the other reels mounted on the apparatus described. The path followed by the wire 66 during the operation of the machine is shown in FIGS. 4 and 5. The belts 37 drive the reels 45 rotatingly in the direction indicated by an arrow B in FIG. 5, i.e., in the opposite direction from that in which the coil 53 is wound on the barrel of the reel, so that under the effect of centrifugal force, a section of wire forms a loop 66*a* running from the surface of the coil 53 up to where it contacts the loop-guard 41 and from there to the free end of the shaft 35, where the wire 66 enters the channel 52. The result is a device for tensioning the wire by the effect of centrifugal force, which device is compact in its construction and easily regulated. One need only vary the speed of rotation of the motor driving the pulleys 36 to modify the centrifugal force exerted on the loops 66*a* formed about each reel 45 in exactly the same way for all four wires of the quad. Thus the tensions to which these different wires are subjected remain constantly equal.

The protective channels 46 and 49 play an important part in the operation of the apparatus described by ensuring that the wire is paid out regularly from the reels even when these are standard reels wound on automatic winding-machines, particularly on winding-machines having continuous transfer of wire from one reel to the next. Such automatic winding-machines necessarily leave a wire-tail at the start of winding, the length of this wire-tail being at least equal to the difference in radii between the barrel of the reel and the periphery of its cheeks. Normally, this wire-tail, which is partially shown as 54 in FIG. 5, is buried in the winding; but as the thickness of the latter gradually diminishes during formation of the cable, the wire-tail appears and begins to stretch out radially by centrifugal force in the vicinity of one or the other of the cheeks of the reel. It will be obvious that if it were not for the protective channels 46 and 49, this wire-tail could, as soon as a certain amount of wire has been paid out, interfere with the section of wire 66 forming the tensioning loop 66*a*, and this in turn could lead to breakage of the wire. However, the protective channels 46 and 49 catch the wire-tail 54 at whichever end of the reel it may be and prevent any interference with the tensioning loop 66*a*.

Finally, the means described above make it possible to control the size of the loops 66*a* when the quadding machine is started up by proceeding in the following manner: once the reels are put in place, the ends of the wires 66 are led into the channels 52, then towards the die, into the twisting apparatus of the quadding machine, and up to the take-up member, usually consisting of a take-up reel. The latter is connected to means for driving it rotatingly, the speed of which is likewise adjustable and which constitute the cable-pulling means. When the machine is started up, the motor of the pay-out apparatus is driven at a gradually increasing speed of rotation according to the rising line 55 on the graph, FIG. 6. After a few seconds, i.e., when a certain predetermined speed of rotation has been reached, acceleration ceases, and this motor is kept at a constant, level speed, as shown by the graph-line 56. At that moment, the quadding machine is started up at a gradually increasing speed according to the rising graph-line 57, and the acceleration of the quadding machine continues linearly until the normal operating speed corresponding to the level graph-line 58 has been reached. Starting at a certain moment, indicated by the dot-dash line 49 on the graph, the pay-out apparatus is once more accelerated according to the graph-line 60 synchronously with the acceleration of the quadding machine until the latter's levelling-off speed as indicated by the graph-line 58 has been reached. The speed of rotation of the reels 45 then corresponds to the level 61, giving the chosen braking value, i.e., the value of the tension to which the wire is subjected.

Upon stopping of the machine, the order of procedure is reversed, as shown by the lines 62, 63, 64, and 65 on the graph, FIG. 6. For slowing down the shafts 35, the control of the drive motor of the belts 37 and the brakes 40 may be used in conjunction. Thus by controlling the speeds of the quadding machine and of the pay-out apparatus according to the graph, FIG. 6, the pay-out apparatus may be brought into an operating condition corresponding to the desired result. The tension on the wires depends upon the size of the loops and the speed of rotation of the pay-out reels.

By way of example, a quadding machine in which copper wires 0.6 mm. in diameter with a polyethylene insulation 1.3 mm. in diameter are stranded to form a quad has operated under the following conditions:

First of all the pay-out reels, having an outside diameter of 450 mm. and an inside diameter of 225 mm., are started up and in three seconds reach a speed of 300 rpm, capable of causing loops to form between the lateral surface of the reels and the loop-guards. The speed is then stabilized, and the quad-stranding and -pulling apparatus are started up at gradually increasing speeds. After these apparatus have started, the speed of rotation of the pay-out reels is increased to 900 rpm, while the speed of rotation of the flyer reaches 1800 rpm and that of the pulling means reaches a value such that the lay of the quad is 80 mm. Under these conditions, which correspond to the standard operating conditions of the machine, the linear speed of the wires and of the quad is therefore 288 m/min.

If need be, the quadding machine might be equipped with a programmed automatic control device for carrying out the program of acceleration and deceleration illustrated in FIG. 6 without manual intervention.

Several types of tensioning devices may be envisaged for equipping a machine such as that shown in FIG. 1. However, experience has shown that in practice, the use of some of these devices entailed difficulties and drawbacks, in certain cases, which it was important to eliminate. The pay-out apparatus equipped with adjustable tensioning devices shown in FIGS. 4 and 5 is particularly advantageous as concerns the putting into operation and operating regularity of the stranding or quadding machine.

However, other designs of the pay-out apparatus described above are also conceivable. Thus, for example, according to the diagram showing in FIG. 7, starting from a conventional pay-out unit 67 in which the axis of the coil of supply wire coincides with the stranding axis, and comprising, as indicated above, a fixed drum 68, a conical loop-guard 69 surrounding the drum 68 and extending in front of it, and a stripping disc 70 surrounding the front cheek of the drum 68, provision may be made for causing a wire 71 to pass successively over two guide members 72 and 73 consisting of pulleys having their axes perpendicular to the direction of travel of the wire 71, and mounted, so as to be tangent to a common straight line, on a movable frame 75 which is rotatable about that straight line. Between the two pulleys 72 and 73, the frame 75 carries a third pulley 76 having its axis parallel to those of the pulleys 72 and 73 and arranged so that the wire passing over the three pulleys follows a more or less triangular path. The intermediate pulley 76, which may be adjacent to the upstream pulley 72, and the downstream pulley 73 constituting a guide member from which the wire is pulled in a direction coinciding with the axis of rotation of the movable frame 75, thus define the ends of a zone through which a section 77 of the wire 71 passes freely. Because the frame 75 is rotated about its axis, the free section 77 of the wire in the aforementioned zone is subjected to a distributed centrifugal force directed perpendicular to the axis of rotation. These tensioning means, added to the conventional pay-out unit 67, constitute a sort of filter for the variations in tension which may have their origin in the wire upon its leaving the pay-out unit, so that any irregularity or jerking would be eliminated downstream from the pay-out unit.

Moreover, instead of centrifugal force being the distributed force to which the section of wire in the free-passage zone is subjected, the apparatus might be designed to utilize other forces, e.g., forces of electromagnetic origin. For that purpose, when the wire is a conductive material, it would suffice to pass a current through the section of wire comprised between the two guide members and to place that section in a magnetic field, this field being uniform and perpendicular to the straight line joining the two guide members, for example. If the wire is given a certain amount of slack when it is installed in the apparatus, it will immediately form a loop in the free-passage zone thus defined. The electromagnetic effects produced between the current passing through the wire and the magnetic field will consequently subject the wire to a tension which will be adjustable independently of the pulling-speed of the wire, and which will make it possible to eliminate the influences of the slight variations due to the mentioned irregularities or to the friction between the turns on the drum or the friction against the stripping disc.

Instead of using a force of electromagnetic origin, the pay-out device may also be designed to use a fluid flow between two coaxial guide members, directed perpendicular to the straight line joining those guide members. It would suffice for that purpose to position a supply-pipe and to limit the passage of the fluid about the wire by partitions defining a thin flow-off conduit into which the fluid would flow, pulling the wire along and causing it to move away laterally.

The pay-out apparatus described above ensure that a wire is paid out at strictly constant tension, and they eliminate the very slight jerks due to the overlapping of the turns on the pay-out reels or drums. These devices do not exclude the presence of brakes for increasing the tension of the wire if that should prove necessary. These brakes may rotate together with the wires if it is desired to avoid additional torsion phenomena.

The use on a quadding machine of a pay-out apparatus such as those which have just been described considerably improves the performance of these machines. It has been found that the capacitance unbalances, among others the $K_1'$ values, decrease appreciably to reach the values predictable on the basis of the calculation. As a matter of fact, it is always necessary to reckon with insulation thicknesses varying by about 0.01 mm. The capacitance unbalances are then attributable to the differences between the wires. They are reduced. By taking care to use identical wires on a quadding machine equipped with devices absorbing the momentary jerks, quads are obtained having $K_1'$ values of less than 20 pf per 300 m. of length.

What is claimed is:

1. A machine for manufacturing cables by stranding individual wires, comprising: a pay-out apparatus having four pay-out reels and fixed supports therefor; a stranding apparatus situated after said pay-out apparatus and comprising a forming die receiving said individual wires; a take-up apparatus having a take-up reel, a support for said take-up reel, and cable-pulling means for pulling said cable through said die at a predetermined speed; and further comprising wire-tensioning means disposed between each of said pay-out reel supports and said die, each of said wire-tensioning means comprising a guide member for one of said wires, disposed at a fixed location and coaxial with a respective one of said reels, a zone situated before said guide member for nonguided passage of a portion of said wire from said reel to said guide member, means for driving each said pay-out reel at a variable speed of rotation, said speed being sufficient to cause said portion of wire to assume the form of a loop under the effect of centrifugal force, thus tensioning said wire through said centrifugal force, and means independent of said cable-pulling means for controlling said variable speed of rotation, said speed of rotation being constantly the same for all said pay-out reels.

2. A machine in accordance with claim 1, wherein said driving means comprise a variable-speed motor, and said pay-out reel supports are parallel rotary shafts each bearing a said pay-out reel and being provided with means for securing said pay-out reel thereto, said shafts being driven in common by said motor.

3. A machine in accordance with claim 2, wherein said pay-out apparatus further comprises a frame, and said shafts are hollow, are mounted on and project out from said frame, and each comprise at their projecting free ends an entry opening, each said opening constituting a respective said guide member.

4. A machine in accordance with claim 2, wherein each said tensioning means further comprises a loop-guard mounted coaxially with a respective said pay-out reel support.

5. A machine in accordance with claim 4, wherein each said loop-guard is integral with a respective said shaft.

6. A machine in accordance with claim 4, wherein said loop-guards are fixed.

7. A machine in accordance with claim 4, wherein said loop-guards are cylindrical.

8. A machine in accordance with claim 2, wherein each said pay-out reel borne by a said shaft comprises two cheeks, each said shaft is provided with two circular channel members each comprising a flat disc disposed perpendicular to the axis of said shaft and a groove-shaped edge portion at the periphery of said disc, and each said channel member is so disposed as to cover a respective said cheek.

9. A machine in accordance with claim 8, wherein one of said channel members is integral with said shaft, and the other of said channel members is integral with said pay-out reel securing means and is detachable.

10. A machine in accordance with claim 2, wherein each said shaft is provided with a brake.

11. A machine in accordance with claim 1, further comprising control means acting upon said tensioning means, said stranding apparatus, and said take-up apparatus for causing said tensioning means to be set in operation before said stranding apparatus and said take-up apparatus are set in operation, and for controlling the increase of said force synchronously with the speed of operation of said stranding apparatus and said take-up apparatus.

12. A machine in accordance with claim 11, wherein said control means are adapted synchronously to reduce said force and slow down said stranding apparatus and said take-up apparatus, and to keep said tensioning means operating for exerting a minimum tension on said wires until said stranding apparatus and said take-up apparatus have ceased operation.

13. A machine for manufacturing cables by stranding individual wires, comprising: a pay-out apparatus having pay-out reels, and fixed supports therefor; a stranding apparatus situated after said pay-out apparatus and comprising a forming die receiving said individual wires; a take-up apparatus having a take-up reel, a support for said take-up reel, and cable-pulling means for pulling said cable through said die at a predetermined speed; and further comprising wire-tensioning means disposed between each of said pay-out reel supports and said die, each of said wire-tensioning means comprising a guide member for one of said wires, disposed at a fixed location and coaxial with a respective one of said reels, a zone situated before said guide member for non-guided passage of a portion of said wire from said reel to said guide member, means for driving each said pay-out reel at a variable speed of rotation, said speed being sufficient to cause said portion of wire to assume the form of a loop under the effect of centrifugal force, thus tensioning said wire through said centrifugal force, and means independent of said cable-pulling means for controlling said variable speed of rotation, said speed of rotation being constantly the same for all said pay-out reels.

14. A machine for manufacturing cables by stranding individual wires, comprising: a pay-out apparatus having pay-out reels and fixed supports therefor; a stranding apparatus situated after said pay-out apparatus and comprising a forming die receiving said individual wires; a take-up apparatus having a take-up reel, a support for said take-up reel, and cable-pulling means for pulling said cable through said die at a predetermined speed; and further comprising wire-tensioning means disposed between each of said pay-out reel supports and said die, each of said wire-tensioning means comprising a frame rotatable about an axis, two guide members mounted on said frame about said axis, a pulley member mounted on said frame between said guide members for causing a section of one of said wires extending between said guide members to follow a non-straight path, and means for rotating said frame at a variable speed of rotation whereby said wire section is subjected to centrifugal force, thus tensioning said wire, and means independent of said cable-pulling means for controlling said variable speed of rotation, said speed of rotation being constantly the same for all said frames.

* * * * *